US011046077B2

(12) United States Patent
Hirai et al.

(10) Patent No.: US 11,046,077 B2
(45) Date of Patent: Jun. 29, 2021

(54) LIQUID EJECTION HEAD

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/832,044

(22) Filed: Mar. 27, 2020

(65) Prior Publication Data

US 2020/0376839 A1 Dec. 3, 2020

(30) Foreign Application Priority Data

Jun. 3, 2019 (JP) ..... JP2019-103662

(51) Int. Cl.
*B41J 2/14* (2006.01)

(52) U.S. Cl.
CPC .... *B41J 2/1433* (2013.01); *B41J 2002/14411* (2013.01); *B41J 2002/14419* (2013.01); *B41J 2002/14483* (2013.01)

(58) Field of Classification Search
CPC ..... B41J 2/1433; B41J 2002/14411; B41J 2002/14483; B41J 2002/14419
See application file for complete search history.

(56) References Cited

U.S. PATENT DOCUMENTS

2017/0297331 A1 10/2017 Kobayashi
2020/0307213 A1* 10/2020 Hirai ..... B41J 2/14233

FOREIGN PATENT DOCUMENTS

WO 2016/047553 A1 3/2016

* cited by examiner

*Primary Examiner* — Lamson D Nguyen
(74) *Attorney, Agent, or Firm* — Banner & Witcoff, Ltd.

(57) ABSTRACT

A liquid ejection head includes a stack structure including plates stacked and bonded with an adhesive agent, individual channels formed in the stack structure, dummy channels formed in the stack structure separately from the individual channels, and a first relief groove formed in the stack structure separately from the individual channels and configured to trap therein an excessive adhesive agent. Each individual channel includes a pressure chamber to which pressure is applied for liquid ejection form a nozzle, a supply throttle channel connected to the pressure chamber, and a return throttle channel communicating with the pressure chamber. The supply throttle channel and the return throttle channel each have a smaller cross-sectional area than the pressure chamber. The dummy channels include dummy chambers arranged laterally to an array of the pressure chambers arranged in an array direction. The first relief groove is connected to the dummy channels.

14 Claims, 5 Drawing Sheets

LIQUID EJECTION HEAD

CROSS-REFERENCE TO RELATED APPLICATION

This application claims priority from Japanese Patent Application No. 2019-103662 filed on Jun. 3, 2019, the content of which is incorporated herein by reference in its entirety.

TECHNICAL FIELD

Aspects of the disclosure relate to a liquid ejection head.

BACKGROUND

A known liquid ejection head includes a stack structure including a plurality of stacked plates. The stack structure includes ejection holes for liquid ejection, pressure chambers respectively connected to the ejection holes, narrow individual channels respectively connected to the pressure chambers, and dummy pressure chambers.

SUMMARY

Such a stack structure is formed, as an example, by stacking and compressing a plurality of plates with an adhesive agent. In this case, an adhesive agent overflowing from a bonding zone of the plates may enter and fill a dummy pressure chamber. The adhesive agent may further enter some of the narrow individual channels connected to the respective dummy pressure chambers, causing clogging of the individual channels.

Aspects of the disclosure provide a liquid ejection head configured to reduce clogging of individual channels.

According to one or more aspects of the disclosure, a liquid ejection head includes a stack structure including a plurality of plates stacked and bonded at facing surfaces of adjacent plates with an adhesive agent, a plurality of individual channels formed in the stack structure, a plurality of dummy channels formed in the stack structure separately from the plurality of individual channels, and a first relief groove formed in the stack structure separately from the plurality of individual channels and configured to trap therein an excessive adhesive agent between the adjacent plates. Each of the individual channels includes a pressure chamber, a supply throttle channel, and a return throttle channel. An ejection pressure is applied to the pressure chamber for liquid ejection from a nozzle. The supply throttle channel is connected to the pressure chamber and to a supply manifold having a supply opening through which liquid is supplied. The supply throttle channel has a smaller cross-sectional area than the pressure chamber. The return throttle channel communicates with the pressure chamber and is connected to a return manifold having a return opening through which liquid is discharged. The return throttle channel has a smaller cross-sectional area than the pressure chamber. The dummy channels include dummy chambers arranged laterally to an array of the pressure chambers arranged in an array direction. The first relief groove is connected to the dummy channels.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings.

First Illustrative Embodiment

A liquid ejection apparatus 10 including a liquid ejection head 20 (hereinafter referred to as a "head") according to a first illustrative embodiment is configured to eject liquid. Hereinafter, the liquid ejection apparatus 10 will be described by way of example as applied to, but not limited to, an inkjet printer.

<Structure of Liquid Ejection Apparatus>

Figure 1:
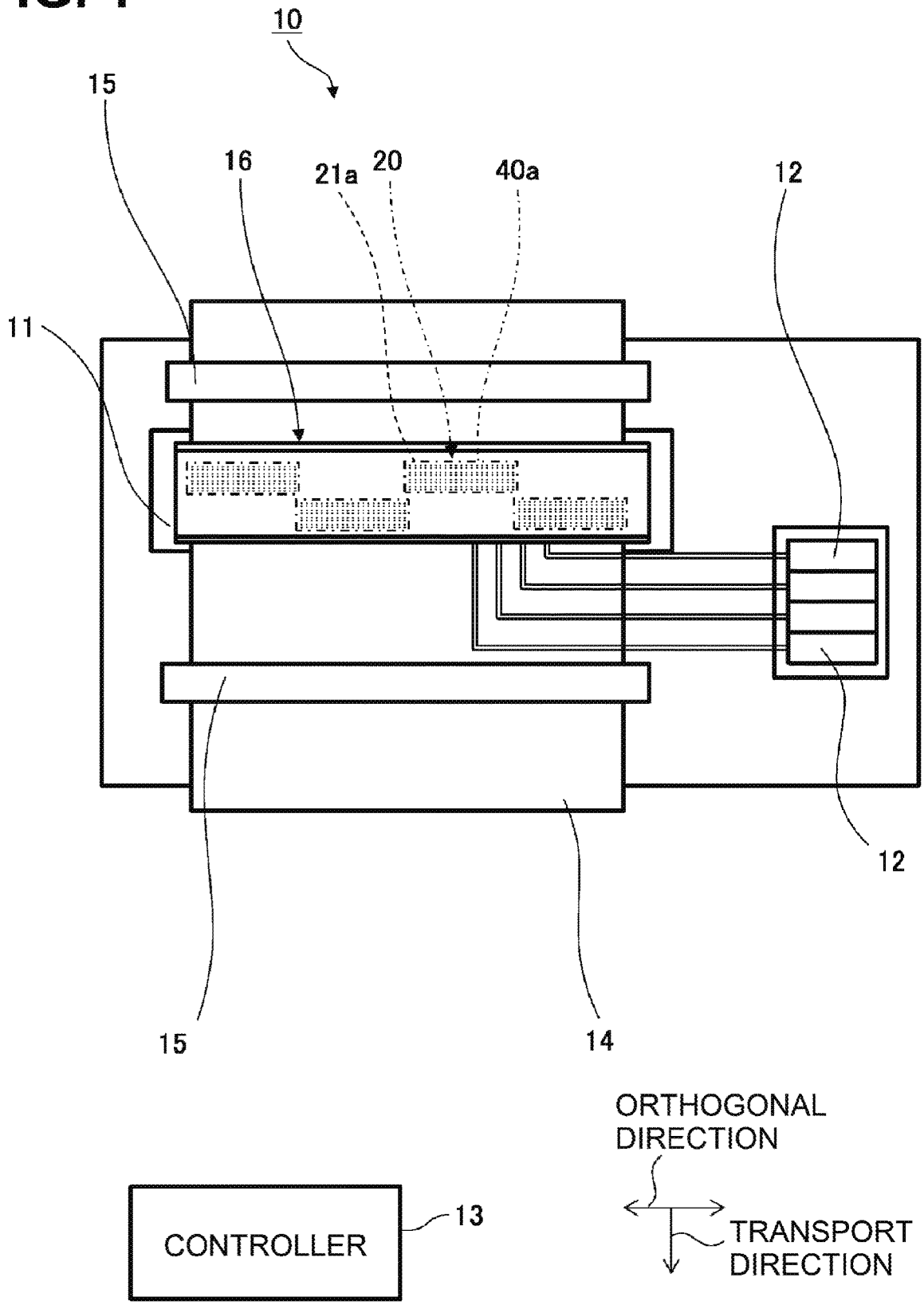
FIG. 1 is a schematic diagram of a liquid ejection apparatus including a liquid ejection head according to a first illustrative embodiment.

As shown in FIG. 1, the liquid ejection apparatus 10 employs a line head type and includes a platen 11, a transport unit, a head unit 16, tanks 12, and a controller 13. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are disposed parallel to each other while interposing the platen 11 therebetween in a transport direction, and are connected to the transport motor. When the transport motor is driven, the transport rollers 15 rotate to transport the sheet 14 on the platen 11 in the transport direction.

The head unit 16 has a length greater than or equal to the length of the sheet 14 in a direction (an orthogonal direction) orthogonal to the transport direction of the sheet 14. The head unit 16 includes a plurality of heads 20.

Each head 20 includes a channel unit and a volume changer. The channel unit includes liquid channels formed therein and a plurality of nozzle holes 21*a* open on a lower surface (an ejection surface 40*a*). The volume changer is driven to change the volume of a liquid channel. In this case, a meniscus in a nozzle hole 21*a* vibrates and liquid is ejected from the nozzle hole 21*a*. The head 20 will be described in detail later.

Separate tanks 12 are provided for different kinds of inks. For example, each of four tanks 12 stores therein a corresponding one of black, yellow, cyan, and magenta inks. Inks of the tanks 12 are supplied through corresponding liquid channels to corresponding nozzle holes 21*a*.

The controller 13 includes a processor such as a central processing unit (CPU), memories such as a random access memory (RAM) and a read only memory (ROM), and driver integrated circuits (ICs) such as an application specific integrated circuit (ASIC). In the controller 13, upon receipt of various requests and detection signals from sensors, the CPU causes the RAM to store various data and outputs various execution commands to the ASIC based on programs stored in the ROM. The ASIC controls the driver ICs based on the commands to execute required operation. The transport motor and the volume changer are thereby driven.

Specifically, the controller 13 executes ejection from the head unit 16, and transport of sheets 14. The head unit 16 is controlled to eject ink from the nozzle holes 21*a*. A sheet 14 is transported in the transport direction intermittently by a predetermined amount. Printing progresses by execution of ink ejection and sheet transport.

<Structure of Head>

Figure 2:
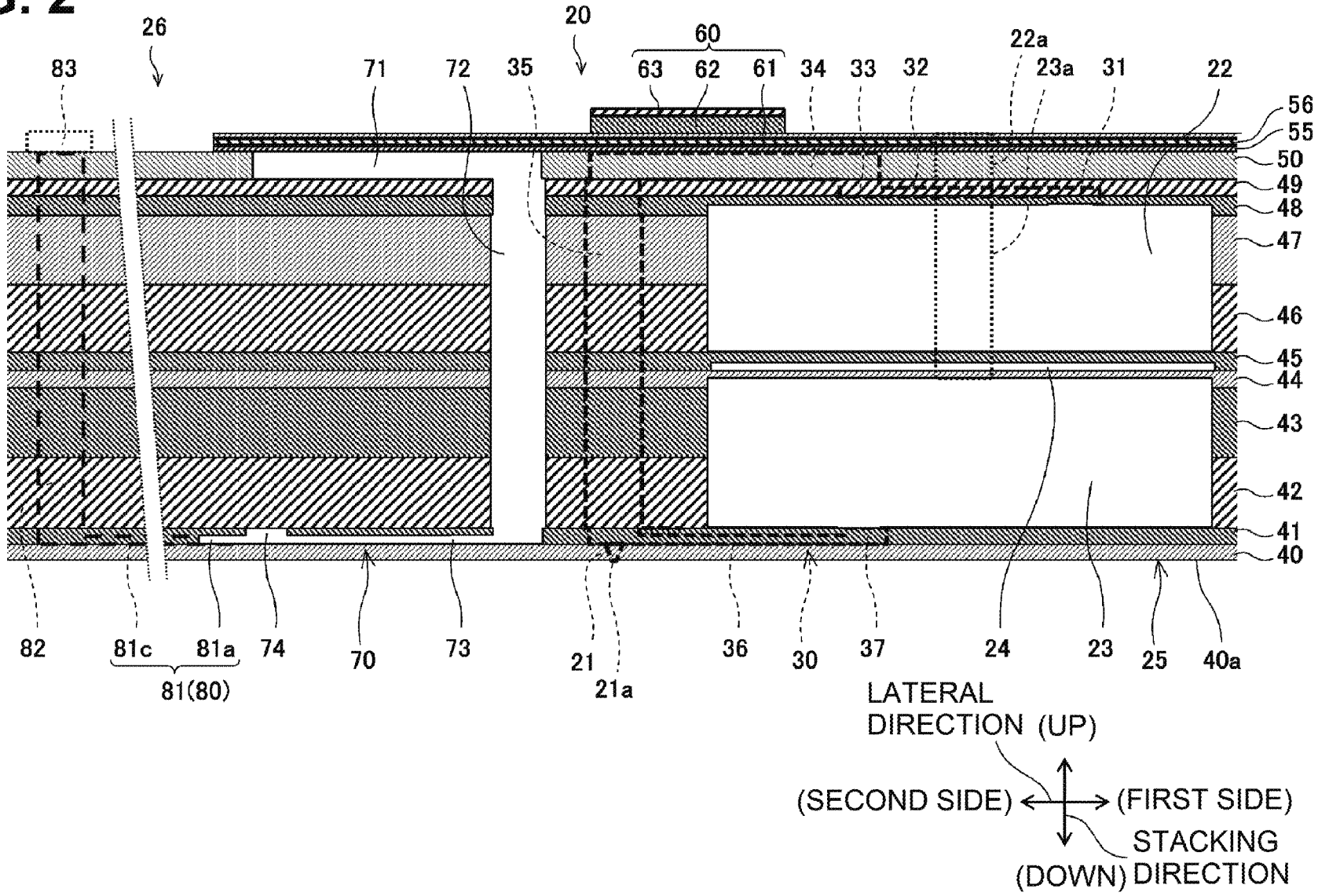
FIG. 2 is a cross-sectional view of the liquid ejection head of FIG. 1 taken along a line orthogonal to an array direction.
Figure 3:
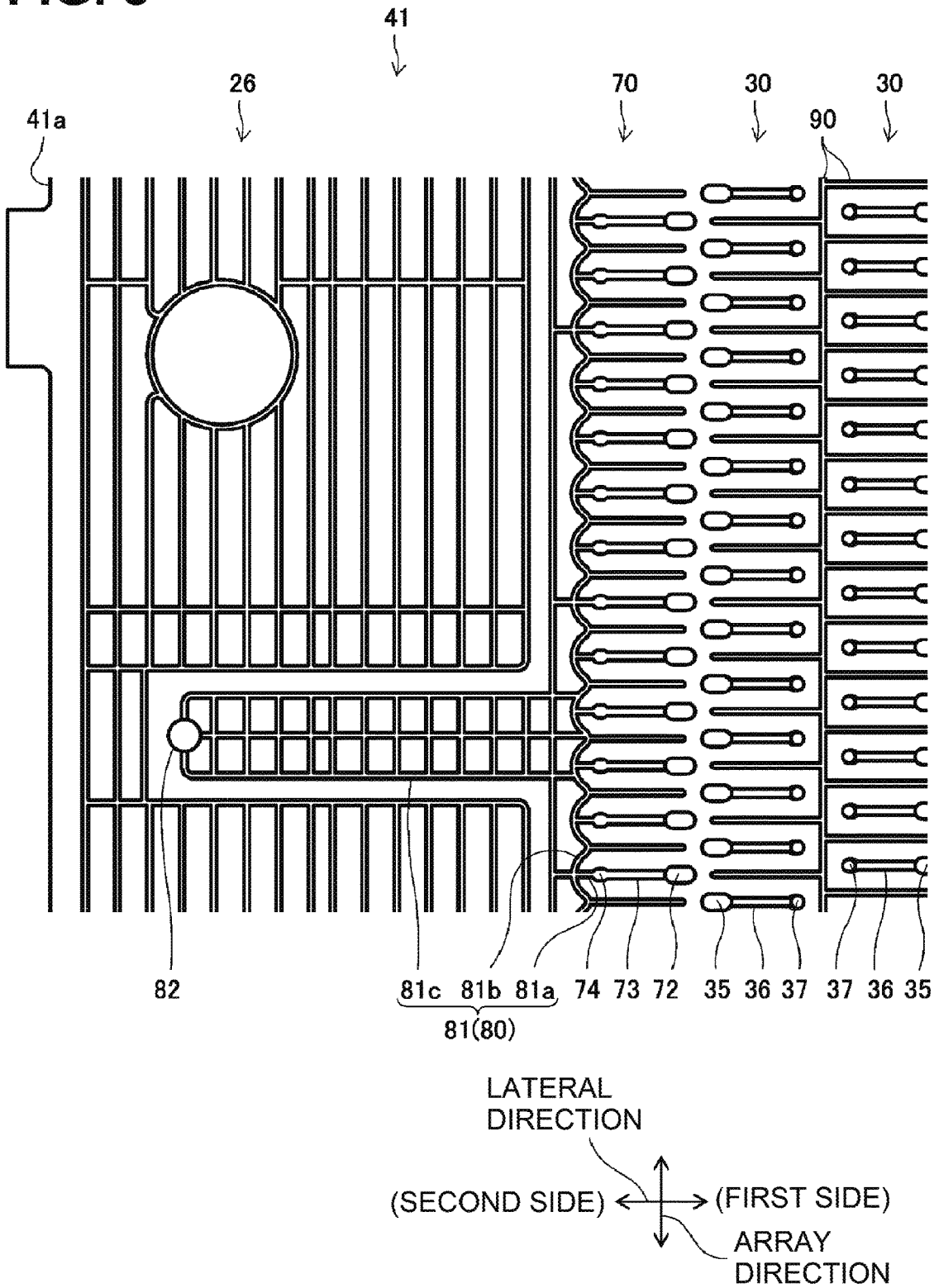
FIG. 3 is a partial view of a lower surface of a first channel plate of the liquid ejection head.

As described above, each head 20 includes the channel unit and the volume changer. As shown in FIGS. 2 and 3, the channel unit includes a stack structure 25 of a plurality of plates, and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, and a 10th channel plate 50. These plates are stacked in this order in a stacking direction. The plurality of plates may include the vibration plate 55.

Each plate has holes and grooves of various sizes. A combination of holes and grooves in the stacked plates of the channel unit define liquid channels such as a plurality of nozzles 21, a plurality of individual channels 30, a plurality of dummy channels 70, a first relief groove 80, a second relief groove 90, a supply manifold 22, and a return manifold 23. The dummy channels 70, the first relief groove 80, and the second relief groove 90 are provided separately from the individual channels 30. These elements will be described in detail later.

The nozzles 21 are formed to penetrate the nozzle plate 40 in the stacking direction. Each nozzle 21 extends in the stacking direction and has a distal-end opening (a nozzle hole 21*a*) and a base-end opening opposite to the distal-end opening. For example, each nozzle 21 has a shape of a cone without a tip, and the area of the base-end opening is greater than that of the nozzle hole 21*a*. The nozzle holes 21*a* are arranged, as a nozzle array, in an array direction on the ejection surface 40*a* of the nozzle plate 40.

The array direction is orthogonal to the stacking direction and may be parallel or inclined relative to the orthogonal direction shown in FIG. 1. A lateral direction is a direction orthogonal to the stacking direction and crossing (e.g., orthogonal to) the array direction, and may be parallel or inclined relative to the transport direction.

The supply manifold 22 and the return manifold 23 extend long in the array direction and are connected to the individual channels 30. The supply manifold 22 has a supply opening 22*a* at an end in its longitudinal direction, and the return manifold 23 has a return opening 23*a* at an end in its longitudinal direction. The supply manifold 22 is stacked on the return manifold 23 to overlap the return manifold 23 in the stacking direction.

The cross-sectional area defined by the supply manifold 22 to face the array direction is equal to the cross-sectional area defined by the return manifold 23 to face the array direction. For example, the supply manifold 22 and the return manifold 23 may be the same in size and shape in the lateral direction and in the stacking direction. The return manifold 23 may be longer than the supply manifold 22 in the array direction.

The supply manifold 22 is formed by through-holes penetrating in the stacking direction the sixth channel plate 46 and the seventh channel plate 47, and a recess recessed from a lower surface of the eighth channel plate 48. The recess overlaps the through-holes in the stacking direction. A lower end of the supply manifold 22 is covered by the fifth channel plate 45, and an upper end of the supply manifold 22 is covered by an upper portion of the eighth channel plate 48.

The return manifold 23 is formed by through-holes penetrating in the stacking direction the second channel plate 42 and the third channel plate 43, and a recess recessed from a lower surface of the fourth channel plate 44. The recess overlaps the through-holes in the stacking direction. A lower end of the return manifold 23 is covered by the first channel plate 41, and an upper end of the return manifold 23 is covered by an upper portion of the fourth channel plate 44.

The supply manifold 22 and the return manifold 23 define a buffer space 24 therebetween. The buffer space 24 is formed by a recess recessed from a lower surface of the fifth channel plate 45. In the stacking direction, the supply manifold 22 and the buffer space 24 are adjacent to each other via an upper portion of the fifth channel plate 45, and the return manifold 23 and the buffer space 24 are adjacent to each other via an upper portion of the fourth channel plate 44. The buffer space 23 sandwiched between the supply manifold 22 and the return manifold 23 may reduce interaction between the liquid flow pressure in the supply manifold 22 and the liquid flow pressure in the return manifold 23.

The plurality of individual channels 30 are branched from the supply manifold 22 and merge into the return manifold 23. Each individual channel 30 is connected, at its upstream end, to the supply manifold 22, connected, at its downstream end, to the return manifold 23, and connected, at its midstream, to a base end of a corresponding nozzle 21. Each individual channel 30 includes a first hole 31, a supply throttle channel 32, a second hole 33, a pressure chamber 34, a descender 35, a return throttle channel 36, and a third hole 37, which are arranged in this order.

The first hole 31 is connected, at its lower end, to an upper end of the supply manifold 22, and extends upward from the supply manifold 22 in the stacking direction to penetrate an upper portion of the eighth channel plate 48 in the stacking direction. The first hole 31 is offset to one side (a first side) from a center of the supply manifold 22 in the lateral direction. The cross-sectional area defined by the first hole 31 to be orthogonal to the stacking direction is less than the cross-sectional area defined by the supply manifold 22 to be orthogonal to the array direction.

The supply throttle channel 32 is connected, at its first-side end, to an upper end of the first hole 31 and extends toward a second side in the lateral direction. The supply throttle channel 32 is formed by a groove recessed from a lower surface of the ninth channel plate 49. The cross-sectional area defined by the supply throttle channel 32 to be orthogonal to the lateral direction is less than the cross-sectional area defined by the first hole 31 to be orthogonal to the stacking direction.

The second hole 33 is connected, at its lower end, to a second-side end of the supply throttle channel 32 and extends from the supply throttle channel 32 upward in the stacking direction to penetrate an upper portion of the ninth channel plate 49 in the stacking direction. The second hole 33 is offset to the other side (a second side) from the center of the supply manifold 22 in the lateral direction. The cross-sectional area defined by the second hole 33 to be orthogonal to the stacking direction is greater than the cross-sectional area defined by the supply throttle channel 32 to be orthogonal to the lateral direction.

The pressure chamber 34 is connected, at its first-side end, to an upper end of the second hole 33 and extends toward a second side in the lateral direction. The pressure chamber 34 penetrates the 10th channel plate 50 in the stacking direction. The cross-sectional area defined by the pressure chamber 34 to be orthogonal to the lateral direction is greater than or equal to the cross-sectional area defined by the second hole 33 to be orthogonal to the stacking direction.

The descender 35 has a columnar shape such as a cylindrical shape and is located to a second side in the lateral direction of the supply manifold 22 and the return manifold 23. The descender 35 is formed by through-holes penetrating in the stacking direction the first channel plate 41 through the ninth channel plate 49. The descender 35 is connected, at its upper end, to the second-side end of the pressure chamber 34 and extends from that connected portion downward in the sacking direction. The base-end opening of the nozzle 21 is connected to a center of a lower end of the descender 35.

The return throttle channel 36 is connected, at its second-side end, to the lower end of the descender 35 and extends from the descender 35 toward a first side in the lateral direction. The return throttle channel 36 is formed by a groove recessed from a lower surface of the first channel plate 41. The cross-sectional area defined by the return throttle channel 36 to be orthogonal to the lateral direction is less than the cross-sectional area defined by the descender 35 to be orthogonal to the stacking direction.

The third hole 37 is connected, at its lower end, to a first-side end of the return throttle channel 36 and extends from the return throttle channel 36 upward in the stacking direction to penetrate an upper portion of the first channel plate 41. The third hole 37 is connected, at its upper end, to a lower end of the return manifold 23. The third hole 37 is offset to a second side from a center of the return manifold 23 in the lateral direction. The cross-sectional area defined by the third hole 37 to be orthogonal to the stacking direction is greater than the cross-sectional area defined by the return throttle channel 36 to be orthogonal to the array direction.

The vibration plate 55 is stacked on the 10th channel plate 50 to cover upper openings of the pressure chambers 34. The vibration plate 55 may be integral with the 10th channel plate 50. In this case, each pressure chamber 34 is recessed from a lower surface of the 10th channel plate 50. An upper portion of the 10th channel plate 50, which is above each pressure chamber 34, functions as the vibration plate 55.

Each piezoelectric element 60 includes a common electrode 61, a piezoelectric layer 62, and an individual electrode 63, which are arranged in this order. The common electrode 61 entirely covers the vibration plate 55 via the insulating film 56. Each piezoelectric layer 62 is provided for a corresponding pressure chamber 34 and is located on the common electrode 61. Each individual electrode 63 is located on a corresponding piezoelectric layer 62 to overlap a corresponding pressure chamber 34. In this case, a piezoelectric element 60 is formed by an active portion of a piezoelectric layer 62, which is sandwiched by an individual electrode 63 and the common electrode 61.

Each individual electrode 63 is electrically connected to a driver IC. The driver IC receives control signals from the controller 13 (FIG. 1) and generates drive signals (voltage signals) selectively to the individual electrodes 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 34. This applies a pressure to the corresponding pressure chamber 34 which in turn ejects liquid from a nozzle 21.

<Liquid Flow>

For example, the supply opening 22*a* of the supply manifold 22 is connected, via a supply conduit, to a subtank, and the return opening 23*a* of the return manifold 23 is connected, via a return conduit, to the subtank. When a pressure pump in the supply conduit and a negative-pressure pump in the return conduit are driven, liquid from the subtank passes through the supply conduit to flow into the supply manifold 22 where liquid flows in the array direction.

Meanwhile, liquid partially flows into the individual channels 30. In each individual channel 30, liquid flows from the supply manifold 22, via the first hole 31, into the supply throttle channel 32 where liquid flows in the lateral direction. Liquid further flows from the supply throttle channel 32, via the second hole 33, into the pressure chamber 34 where liquid flows in the lateral direction. Then, liquid flows from an upper end to a lower end of the descender 35 in the stacking direction to enter the nozzle 21. When the piezoelectric element 60 applies an ejection pressure to the pressure chamber 34, liquid is ejected from a nozzle hole 21*a*.

The remaining liquid flows from the descender 35 to the return throttle channel 36 and enters, via the third hole 37, the return manifold 23. Then, liquid passes the return manifold 23 in the array direction and returns through the return conduit to the subtank. Thus, liquid not having flown into the individual channels 30 circulates between the subtank and the individual channels 30.

<Structures of Dummy Channels, First Relief Groove, and Second Relief Groove>

The dummy channels 70 are arranged, as an array, in the array direction, and the individual channels 30 are arranged, as an array, in the array direction. An array of dummy channels 70 is provided at each of opposite ends of the stack structure 25 in the lateral direction. A plurality of arrays of individual channels 30 are sandwiched between two arrays of dummy channels 70. The two arrays of dummy channels 70 are symmetrical to each other relative to a cross section thereof orthogonal to the lateral direction. Hereinafter, among the two arrays of dummy channels 70, an array of dummy channels 70 located at a second side in the lateral direction will be described.

Also, the two arrays of individual channels 30 are symmetrical to each other relative to a cross section thereof orthogonal to the lateral direction, and are connected to the same supply manifold 22 and return manifold 23. The stack structure 25 includes an edge portion 26 located opposite to the arrays of individual channels 30 relative to the array of dummy channels 70 in the lateral direction. The edge portion 26 is located between the array of dummy channels 70 and an end of the stack structure 25.

Each dummy channel 70 is filled with no liquid and includes a dummy chamber 71, a dummy descender 72, a dummy return channel 73, and a first dummy hole 74, which are arranged in this order. The dummy chamber 71, the dummy descender 72, the dummy return channel 73, and the first dummy hole 74 may be the same in shape and size as the pressure chamber 34, the descender 35, the return throttle channel 36, and the third hole 37, respectively.

The dummy chamber 71 penetrates the 10th channel plate 50 in the stacking direction. A plurality of dummy chambers 71 are arranged, as an array, in the array direction. The array of dummy chambers 71 is located laterally to an array of pressure chambers 34. The dummy chambers 71 are not connected to the supply manifold 22.

The dummy descender 72 penetrates in the stacking direction the first channel plate 41 through the ninth channel plate 49. The dummy descender 72 is connected, at its upper end in the stacking direction, to a first-side end of the dummy chamber 71. The dummy descender 72 is not connected to a nozzle 21 nor open on the ejection surface 40*a*.

The dummy return channel 73 is connected, at its first-side end, to a lower end of the dummy descender 72 and extends from that connected portion toward a second side in the lateral direction. The dummy return channel 73 is formed by a groove recessed from a lower surface of the first channel plate 41. The cross-sectional area defined by the dummy return channel 73 to be orthogonal to the lateral direction is less than the cross-sectional area defined by the dummy chamber 71 to be orthogonal to the lateral direction.

The first dummy hole 74 is connected, at its lower end, to a second-side end of the dummy return channel 73 and extends from the dummy return channel 73 upward in the stacking direction to penetrate an upper portion of the first channel plate 41. The cross-sectional area defined by the first dummy hole 74 to be orthogonal to the stacking direction is greater than the cross-sectional area defined by the dummy return channel 73 to be orthogonal to the lateral direction. The first dummy hole 74 is not connected to the return manifold 23.

The first relief groove 80 includes a return-side relief groove 81 connected to the dummy return channels 73. The return-side relief groove 81 is located at the edge portion 26 between the end 41*a* of the first channel plate 41 and the dummy return channels 73, and is formed by a groove recessed from a lower surface toward an upper surface of the first channel plate 41.

In other words, the first channel plate 41 is a grooved plate formed with the return-side relief groove 81 and the dummy return channels 73. The return-side relief groove 81 and the dummy return channels 73 are open on a lower surface of the first channel plate 41 and do not penetrate through the upper and lower surfaces of the first channel plate 41.

The return-side relief groove 81 includes first groove portions 81*a*, second groove portions 81*b*, and a third groove portion 81*c*. The cross-sectional area defined by each of these groove portions to be orthogonal to its extending direction is equal to or less than the cross-sectional area defined by a corresponding dummy return channel 73 to be orthogonal to the lateral direction.

Each first groove portion 81*a* is connected, at its first side end, to a second-side end of a corresponding dummy return channel 73 and extends from that connected portion toward a second side. Thus, the first groove portion 81*a* and the corresponding dummy return channel 73 are located on the same straight line extending in the lateral direction.

Each second groove portion 81*b* extends in the array direction at a position further to the second side than the first groove portions 81*a* and is connected to corresponding at least two of the first groove portions 81*a*. Each second groove portion 81*b*, which extends in the array direction, is branched toward the first side in the lateral direction to extend between corresponding two dummy return channels 73 adjacent in the array direction. The branched portion is equal or substantially equal in length to the corresponding dummy return channels 73.

Each second groove portion 81*b* extends in the array direction and is curved in the lateral direction to surround the second-side end of the nearest dummy return channel 73 while being spaced by a uniform distance from that second-side end. Each second groove portion 81*b* is curved such that its connected position to a corresponding first groove portion 81*a* is located further to the second side than its branched position.

The third groove portion 81*c* extends in the array direction and is branched at plural positions toward the first side in the lateral direction. The third groove portion 81*c* is also branched to extend toward the second side in the lateral direction and is branched in the array direction to form a meshed pattern. A second-side end of the third groove portion 81*c* is connected to a communication passage 82.

The communication passage 82 is formed by through-holes penetrating in the stacking direction the first channel plate 41 through the 10th channel plate 50. The communication passage 82 is connected, at its lower end, to the return-side relief groove 81 and has an upper-end opening open to an exterior of the stack structure 25. For example, a lid 83 is attachable to the upper-end opening to shut the communication passage 82 from the exterior.

The second relief groove 90 is formed by a groove recessed from a lower surface of the first channel plate 41 and is located at a zone where the individual channels 30 are formed. The second relief groove 90 extends in the array direction at a position between the two arrays of return throttle channels 36 adjacent in the lateral direction. The second relief groove 90 is branched in the lateral direction to extend between every two return throttle channels 36 adjacent in the array direction. The second relief groove 90 is not connected to and thus is separate from the dummy channels 70 and the communication passage 82.

<Assembly of Stack Structure>

The nozzle plate 40 and the first channel plate 41 through the 10th channel plate 50 are prepared by forming grooves and through-holes in each plate. An adhesive agent is applied to an upper surface of the nozzle plate 40, to upper and lower surfaces of the first channel plate 41 through the ninth channel plate 49, and to a lower surface of the 10th channel plate 50. These plates are stacked one on another and compressed. The adhesive agent may be applied to either one of upper and lower facing surfaces of these plates.

The facing surfaces of the nozzle plate 40 and the first channel plate 41 through the 10th channel plate are bonded to each other by the adhesive agent to form the stack structure 25. The stack structure 25 may be formed by applying the adhesive agent to one of a lower surface of the vibration plate 55 and an upper surface of the 10th channel plate 50, by staking the vibration plate 55 on the 10th channel plate 50, and by compressing the vibration plate 55 together with the other plates.

In order to securely bond the plates, an excessive amount of the adhesive agent is applied to the facing surfaces. Thus, an excessive adhesive agent flows from a bonding zone between the upper surface of the nozzle plate 40 and the lower surface of the first channel plate 41. The lower surface of first channel plate 41 includes the return throttle channels 36 with a small cross-sectional area. If a large amount of excessive adhesive agent flows into the return throttle channels 36, the return throttle channels 36 may be clogged.

However, to cope with this, the lower surface of the first channel plate 41 includes the return-side relief groove 81, the second relief groove 90, and the dummy return channels 73. An excessive adhesive agent flows into these grooves and channels to be trapped there. An excessive adhesive agent flowing into the return-side relief groove 81 and the dummy return channels 73 passes the return-side relief groove 81 and exits, via the communication passage 82, to the exterior of the stack structure 25. This may reduce filling of the return relief groove 81 and the dummy return channels 73 with an excessive adhesive agent, and reduce clogging of the narrow return throttle channels 36 with the excessive adhesive agent flowing there, instead of flowing into the groove 81 and the channels 73.

In this case, the return-side relief groove 81, which is branched and formed into a meshed pattern, provides a plurality of paths through which an excessive adhesive agent flows from the dummy return channels 73, via the return-side relief groove 81, to the communication passage 82. Even when the return-side relief groove 81 is partially clogged with an excessive adhesive agent, an excessive adhesive agent flowing into the dummy return channels 72 is discharged, via unclogged paths of the return-side relief groove, to the communication passage 82. This may reliably reduce filling of the return throttle channels 36 with an excessing adhesive agent.

Once the facing surfaces are bonded in the stack structure 25, the upper-end opening of the communication passage 82 is covered with the lid 83. Thus, the communication passage 82 and the dummy channels 70 are shut from the exterior.

<Effects>

In the head 20, the first relief groove 80 is connected to the dummy channels 70. This allows an excessive adhesive agent overflowing from the bonding zone between the facing surfaces to flow into the dummy channels 70 and to the first relief groove 80. This may reduce the amount of excessive adhesive agent flowing into the individual channels 30 and reduce clogging of the narrow return channels 36 of the individual channels 30 with the excessive adhesive agent.

In the stack structure 25 of the head 20, the dummy channels 70 include, at a layer provided with the return throttle channels 36, the dummy return channels 73 which respectively communicate with the dummy chambers 71 and have a smaller cross-sectional area than the dummy chambers 71. The first relief groove 80 is connected to the dummy return channels 73.

For example, the first channel plate 41 includes, at its lower surface, the return throttle channels 36 and the dummy return channels 73 to which the return-side relief groove 81 is connected. Thus, any excessive adhesive agent flowing into the dummy return channels 73 flows from the dummy return channels 73 to the return-side relief groove 81. This may reduce clogging of the narrow dummy return channels 73 with the excessive adhesive agent. Without such a clog in the dummy return channels 73, the excessive adhesive agent is prevented from flowing into the return throttle channels 36, instead of flowing into the dummy channels 70. This may reduce clogging of the return throttle channels 36 with the excessive adhesive agent.

In the head 20, the stack structure 25 includes the grooved plate formed with the first relief groove 80 and the dummy return channels 73. The first relief groove 80 and the dummy return channels 73 are open on one and same surface of the two facing surfaces.

Thus, the grooved plate (the first channel plate 41) may be machined, from its lower surface, to form therein the return-side relief groove 81 of the first relief groove 80 and the dummy return channels 73. The return-side relief groove 81 and the dummy return channels 73 are formed in the same surface. This may facilitate forming the return-side relief groove 81 and the dummy return channels 73 while adjusting the positional relation therebetween.

In the head 20, the dummy return channels 73 are arranged in the array direction. The first relief groove 80 includes the first groove portions 81*a* each connected to one end of a corresponding dummy return channel 73, and the second groove portions 81*b* each connected to corresponding at least two first groove portions 81*a*. Each second groove portion 81*b* extends in the array direction in a curved manner to surround the nearest one of the ends of the dummy return channels 73.

This allows each second groove portion 81*b* to uniformly trap therein an excessive adhesive agent around the one end of a corresponding dummy return channel 73. This may reduce the amount of excessive adhesive agent flowing into the dummy return channels 73, reduce clogging of the dummy return channels 73 with the excessive adhesive agent, and thus clogging of the return throttle channels 36 with the excessive adhesive agent.

The head 20 includes an array of dummy channels 73 arranged in the array direction, and an array of return throttle channels 36 arranged in the array direction. The array of return throttle channels 36 is located laterally to the array of dummy channels 73, in a direction orthogonal to the array direction. The head 20 further includes the edge portion 26 located opposite to the array of return throttle channels 36 relative to the array of the dummy return channels 73 in the direction orthogonal to the array direction.

Specifically, the first channel plate 41 includes, at its lower surface, the edge portion 26, the array of dummy return channels 73, the array of the return throttle channels 36, in this order from the end 41*a*. Because the edge portion 26 is located near the end 41*a*, a relatively greater amount of adhesive agent is applied to the edge portion 26 than to a zone where the dummy return channels 73 and the return throttle channels 36 are formed. This may reliably prevent leakage of liquid from the individual channels 30, through the end 41*a* of the first channel plate 41, to the exterior.

Even when a relatively greater amount of adhesive agent is applied to the edge portion 26, an excessive adhesive agent flows from the edge portion 26 into the dummy return channels 73 before flowing into the return throttle channels 36. This may reduce entry of the excessive adhesive agent into the return throttle channels 36 and reduce clogging of the channels 36 with the excessive adhesive agent.

The head 20 includes the communication passage 82 through which the first relief groove 80 communicates with the exterior of the stack structure 25. Any excessive adhesive agent entering the dummy channels 70 and the return-side relief groove 81 flows to the exterior via the communication passage 82. This may reduce filling of the dummy channels 70 and the return-side relief groove 81 with an excessive adhesive agent, and reduce the amount of excessive adhesive agent flowing into return throttle channels 36.

The head 20 includes the lid 83 for shutting the communication passage 82 from the exterior. Any bonding failure between plates of the stack structure 25 may cause liquid to leak from the individual channels 30 to the dummy channels 70. Even in this case, the lid 83, which shuts the communication passage 82 from the exterior, may prevent discharge of the liquid from the dummy channels 70 via the communication passage 82.

The head 20 includes the second relief groove 90 for trapping therein an excessive adhesive agent between plates.

The second relief groove 90 is not connected to the dummy channels 70. The second relief groove 90 and the communication passage 82 are separate from each other.

Because the communication passage 82 is not connected to the second relief groove 90, no excessive adhesive agent flows from the second relief groove 90 into the communication passage 82. Thus, the communication passage 82 is used exclusively as a path for an excessive adhesive agent from the return-side relief groove 81. The excessive adhesive agent in the dummy channels 70 is reliably discharged from the communication passage 82 via the return-side relief groove 81. This may prevent leakage of the excessive adhesive agent from the dummy channels 70 to neighboring individual channels 30.

In the head 20, the dummy chambers 71 are filled with no liquid. Thus, discharge of liquid is prevented from the dummy chambers 71, via the return-side relief groove 81 and the communication passage 82, to the exterior.

In the head 20, the stack structure 25 includes the grooved plate including the first relief groove 80. The first relief groove 80 is recessed from either one of the two facing surfaces of the grooved plate and does not penetrate through the two facing surfaces. For example, the grooved plate (the first channel plate 41) is continuous, at its an upper portion of the return-side relief groove 81 of the first relief groove 80, in a direction orthogonal to a direction in which the grooves 80 and 81 are recessed. This may reduce a decrease in strength of the first channel plate 41 due to the return-side relief groove 81.

In the head 20, the stack structure 25 includes the ejection surface 40*a* where the nozzles 21 are open. The dummy channels 70 are not open on the ejection surface 40*a*. If the dummy channels 70 are open on the ejection surface 40*a*, wiping off the liquid on the ejection surface 40*a* may cause the liquid to enter the dummy channels 70 via the openings in the ejection surface 40*a*. In this case, a sheet placed facing the ejection surface 40*a* may be smeared with the liquid having entered and remaining in the dummy channels 70. However, the dummy channels 70 are not open on the ejection surface 40*a*, not causing such a problem.

Second Illustrative Embodiment

Figure 4:
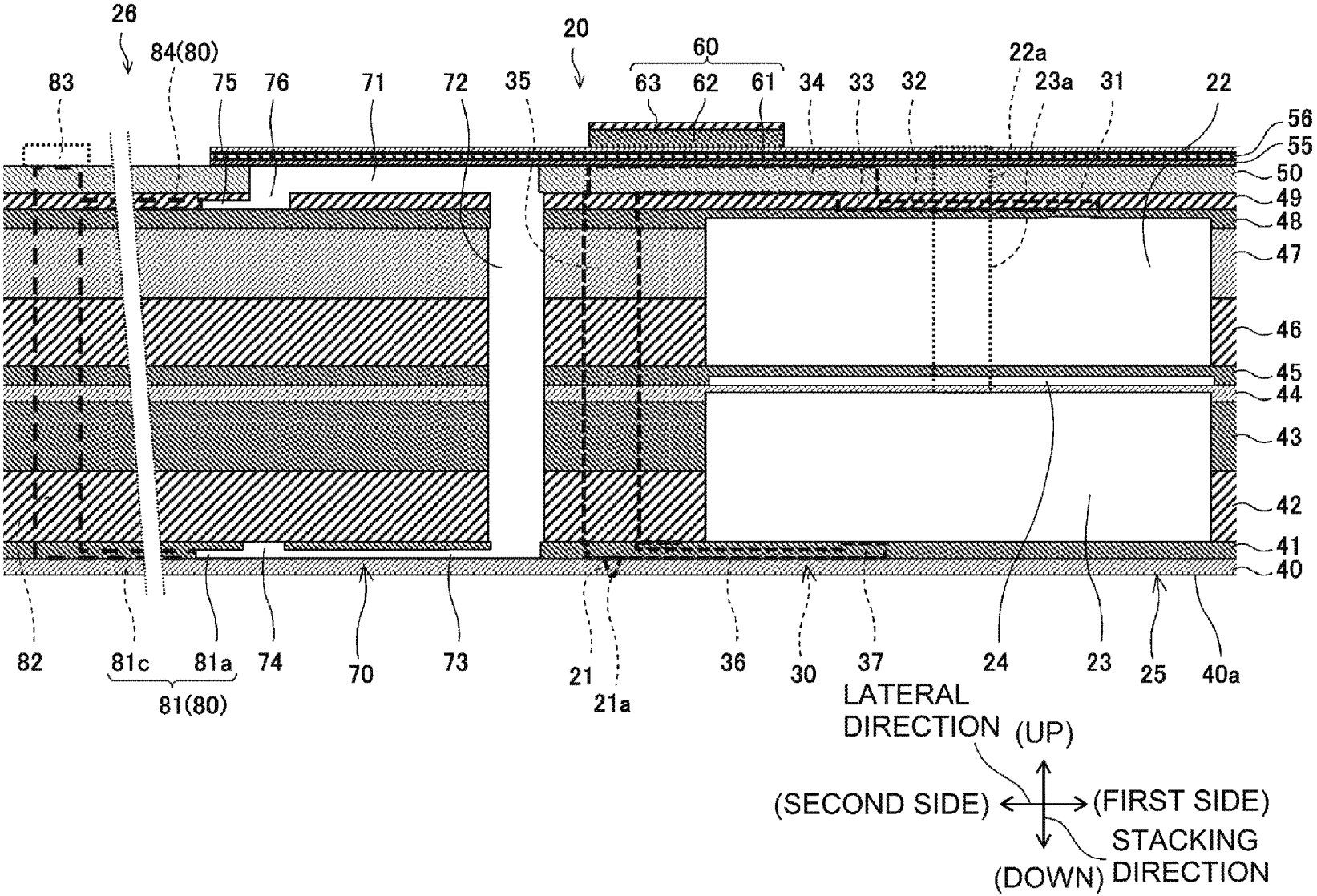
FIG. 4 is a cross-sectional view of a liquid ejection head taken along a line orthogonal to an array direction, according to a second illustrative embodiment.

As shown in FIG. 4, a head 20 according to a second illustrative embodiment defers from the head 20 according to the first illustrative embodiment in that each dummy channel 70 includes a dummy supply channel 75 and that a first relief groove 80 includes a supply-side relief groove 84. The elements other than the above-described elements are similar to those of the first illustrative embodiment and will not be described repeatedly.

Specifically, the dummy supply channel 75 communicates with a corresponding dummy chamber 71 via a second dummy hole 76. The second dummy hole 76 is located in a ninth channel plate 49 including the second holes 33, and penetrates in the stacking direction an upper portion of the dummy supply channel 75 in the ninth channel plate 49. The second dummy hole 76 is connected, at its upper end, to a second-side end of a corresponding dummy chamber 71 and extends downward from the dummy chamber 71 in the stacking direction. The cross-sectional area defined by the second dummy hole 76 to be orthogonal to the stacking direction is less than that defined by the dummy chamber 71 to be orthogonal to the lateral direction, and is equal to that defined by the second hole 33 to be orthogonal to the stacking direction.

The dummy supply channel 75 is connected, at its first-side end, to a lower end of the second dummy hole 76, and extends toward a second side in the lateral direction. The dummy supply channel 75 is formed by a groove recessed from a lower surface of the ninth channel plate 49 including the supply throttle channels 32. The cross-sectional area defined by the dummy supply channel 75 to be orthogonal to the lateral direction is less than that defined by the second dummy hole 76 to be orthogonal to the stacking direction, and is equal to that defined by the supply throttle channel 32 to be orthogonal to the lateral direction.

The supply-side relief groove 84, as the first relief groove 80, traps therein an excessive adhesive agent between an upper surface of an eighth channel plate 48 and a lower surface of the ninth channel plate 49. The supply-side relief groove 84 is located at an edge portion 26 between an end of the ninth channel plate 49 and the dummy supply channels 75, and is formed by a groove recessed from a lower surface toward an upper surface of the ninth channel plate 49.

The supply-side relief groove 84 and the dummy supply channels 75 are open on a lower surface of the ninth channel plate 49 and do not penetrate through the upper and lower surfaces of the ninth channel plate 49. The supply-side relief groove 84 may be formed in the upper surface of the eighth channel plate 48 facing the lower surface of the ninth channel plate 49.

The supply-side relief groove 84 is connected, at its first-side ends, to corresponding second-side ends of the dummy supply channels 75 and extends from that connected portions toward a second side. Similarly to a return-side relief groove 81, the supply-side relief groove 84 may be curved in a direction orthogonal to the stacking direction, branched, and formed into a meshed pattern. The cross-sectional area defined by the supply-side relief groove 84 to be orthogonal to its extending direction is less than or equal to the cross-sectional area defined by each dummy supply channel 75 to be orthogonal to the lateral direction.

In the head 20 according to the second illustrative embodiment, each dummy channel 70 includes a dummy return channel 73 and the dummy supply channel 75. In the stack structure 25, each dummy return channel 73 is located at a layer provided with return throttle channels 36, communicates with a corresponding dummy chamber 71, and has a less cross-sectional area than the corresponding dummy chamber 71. In the stack structure 25, each dummy supply channel 75 is located at a layer provided with supply throttle channels 32, is connected to a corresponding dummy chamber 71, and has a less cross-sectional area than the corresponding dummy chamber 71. The first relief groove 80 includes the return-side relief groove 81 connected to the dummy return channels 73, and the supply-side relief groove 84 connected to the dummy supply channels 75.

An excessive adhesive agent entering the dummy return channels 73 flows to the return-side relief groove 81, and an excessive adhesive agent entering the dummy supply channels 75 flows to the supply-side relief groove 84. This may reduce filling of the dummy return channels 73 and the dummy supply channels 75 with the excessive adhesive agent. This may reduce filling of the return-side relief groove 81 and the dummy return channels 73 with an excessive adhesive agent, and reduce clogging of the narrow return throttle channels 36 and supply throttle channels 32 with the excessive adhesive agent flowing there, instead of flowing into the grooves 81 and 84.

A second relief groove (not shown) may be provided in the lower surface of the ninth channel plate 49 or the upper surface of the eighth channel plate 48 so as not to be connected to the dummy channels 70 and so as to trap therein an excessive adhesive agent.

<First Modification>

A head 20 according to a first modification of the second illustrative embodiment, as shown in FIG. 4, may include a common communication passage 82 through which the return-side relief groove 81 and the supply-side relief groove 84 communicate with an exterior of the stack structure 25. In this case, the communication passage 82, which penetrates the first channel plate 41 through the 10th channel plate 50 in the stacking direction, is connected, at the first channel plate 41, to a second-side end of the return-side relief groove and connected, at the ninth channel plate 49, to a second-side end of the supply-side relief groove 84.

The single communication passage 82 is commonly used for the return-side relief groove 81 and the supply-side relief groove 84, thereby reducing the number of communication passages 82 and downsizing the head 20.

Alternatively, separate communication passages 82 may be provided for the return-side relief groove 81 and the supply-side relief groove 84. Further, the communication passage 82 may be provided separately from the second relief groove (not shown) provided in the lower surface of the ninth channel plate 49 or the upper surface of the eighth channel plate 48.

Third Illustrative Embodiment

Figure 5:
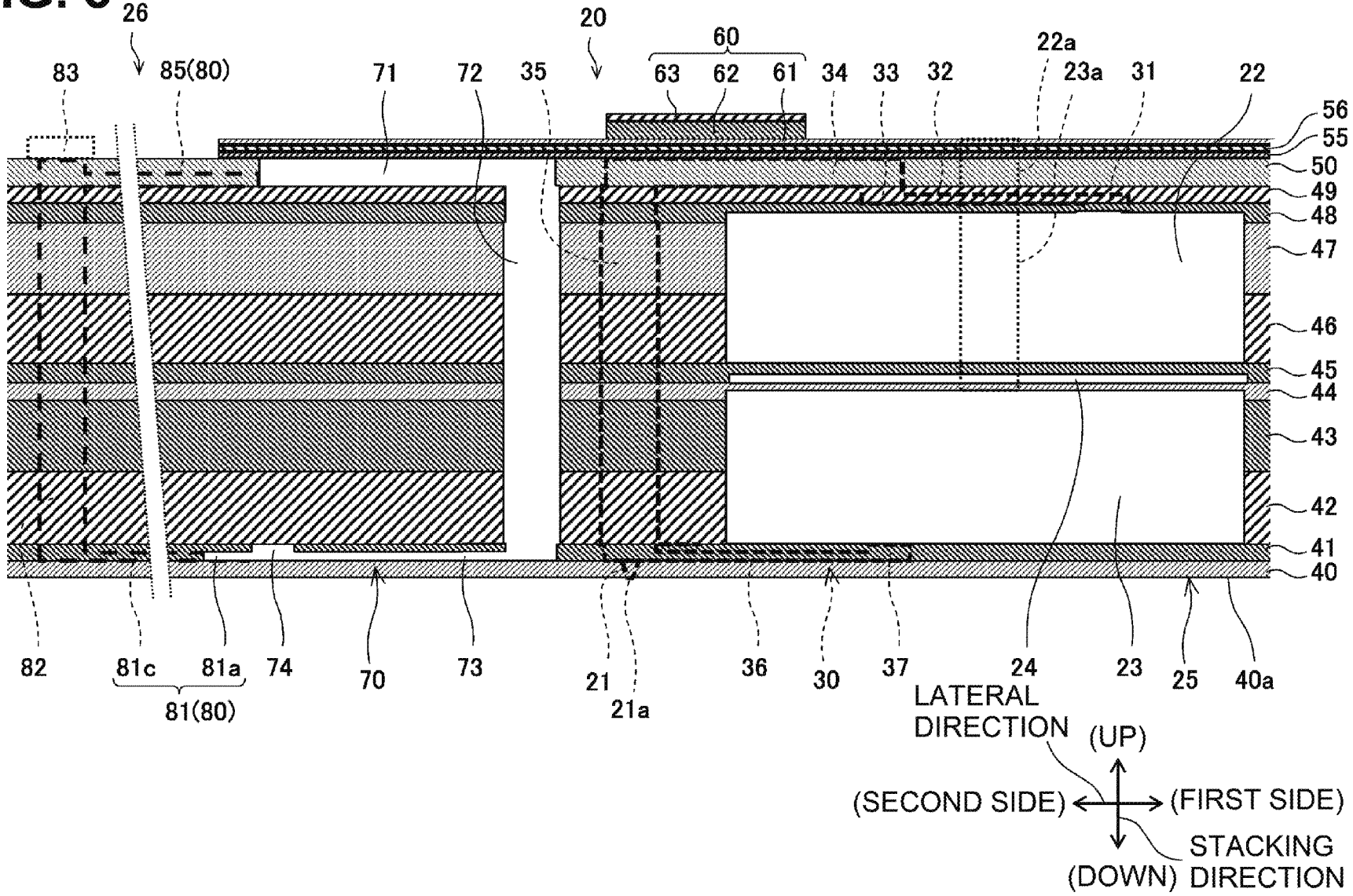
FIG. 5 is a cross-sectional view of a liquid ejection head taken along a line orthogonal to an array direction, according to a third illustrative embodiment.

As shown in FIG. 5, a head 20 according to a third illustrative embodiment defers from the head 20 according to the first illustrative embodiment in that a first relief groove includes a chamber-side relief groove 85 connected to each dummy chamber 71. The elements other than the above-described elements are similar to those of the first illustrative embodiment and will not be described repeatedly.

The chamber-side relief groove 85, as the first relief groove 80, traps therein an excessive adhesive agent between an upper surface of a ninth channel plate 49 and a lower surface of a 10th channel plate 50. The chamber-side relief groove 85 is located at an edge portion 26 between an end of the 10th channel plate 50 and an array of dummy chambers 71, and is formed by a groove recessed from a lower surface toward an upper surface of the 10th channel plate 50. The chamber-side relief groove 85 and the dummy chambers 71 are open on the lower surface of the 10th channel plate 50. The chamber-side relief groove 85 may be formed in the upper surface of the ninth channel plate 49 facing the lower surface of the 10th channel plate 50.

The chamber-side relief groove 85 is connected, at its first-side ends, to corresponding second-side ends of the dummy chambers 71 and extends from that connected portions toward a second side. Similarly to the return-side relief groove 81, the chamber-side relief groove 85 may be curved in a direction orthogonal to the stacking direction, branched, and formed into a meshed pattern in the lower surface of the 10th channel plate 50. The cross-sectional area defined by the chamber-side relief groove 85 to be orthogonal to its extending direction is less than the cross-sectional area defined by each dummy chamber 71 to be orthogonal to the lateral direction.

A communication passage 82 penetrates the first channel plate 41 through the 10th channel plate 50 in the stacking direction. The communication passage 82 is connected, at the first channel plate 41, to a second-side end of the return-side relief groove 81 and connected, at the 10th channel plate 50, to a second-side end of the chamber-side relief groove 84. Alternatively, separate communication passages 82 may be provided for the return-side relief groove 81 and the chamber-side relief groove 85.

Thus, any excessive adhesive agent flowing into the dummy chambers 71 flows from the dummy chambers 71 to the chamber-side relief groove 85. This may reduce filling of the dummy chambers 71 with an excessive adhesive agent and reduce the amount of excessive adhesive agent flowing into the individual channels 30.

A second relief groove (not shown) may be provided in the upper surface of the ninth channel plate 49 or the lower surface of the 10th channel plate 50 so as not to be connected to the dummy channels 70 and so as to trap therein an excessive adhesive agent. The second relief groove may be provided separately from the communication passage 82.

<Other Modifications>

In each of the above-described illustrative embodiments and modification, the return-side relief groove 81 is formed to be recessed from the lower surface of the first channel plate 41. However, the return-side relief groove 81 may be formed to penetrate trough the lower and upper surfaces of the first channel plate 41. Alternatively, the return-side relief groove 81 may be formed to be recessed from the upper surface of the nozzle plate 40 facing the lower surface of the first channel plate 41. In this case also, the return-side relief groove 81 traps therein an excessive adhesive agent between the first channel plate 41 and the nozzle plate 40.

Any elements may be combined across the above-described illustrative embodiments and the modification unless they are incompatible with each other. For example, the head 20 in the third illustrative embodiment may include a dummy supply channels 75 and a supply-side relief groove 84, as in the second illustrative embodiment. The head 20 in the third illustrative embodiment may include the communication passage 82 common to a return-side relief groove 81 and a supply-side relief groove 84, as in the first modification of the second illustrative embodiment.

While the disclosure has been described with reference to the specific embodiments thereof, these are merely examples, and various changes, arrangements and modifications may be applied therein without departing from the spirit and scope of the disclosure.

What is claimed is:

1. A liquid ejection head comprising:

a stack structure including a plurality of plates stacked and bonded at facing surfaces of adjacent plates with an adhesive agent;

a plurality of individual channels formed in the stack structure;

a plurality of dummy channels formed in the stack structure separately from the plurality of individual channels; and a first relief groove formed in the stack structure separately from the plurality of individual channels and configured to trap therein an excessive adhesive agent between the adjacent plates, wherein each of the individual channels includes:

a pressure chamber to which an ejection pressure is applied for liquid ejection from a nozzle, a supply throttle channel connected to the pressure chamber and to a supply manifold having a supply opening through which liquid is supplied, the supply throttle channel having a smaller cross-sectional area than the pressure chamber, and a return throttle channel communicating with the pressure chamber and connected to a return manifold having a return opening through which liquid is discharged, the return throttle channel having a smaller cross-sectional area than the pressure chamber, wherein the dummy channels include dummy chambers arranged laterally to an array of the pressure chambers arranged in an array direction, and wherein the first relief groove is connected to the dummy channels.

2. The liquid ejection head according to claim 1, wherein each of the dummy channels includes, at a plate stacked in the stack structure and having the return throttle channels, a dummy return channel communicating with a corresponding one of the dummy chambers and having a smaller cross-sectional area than the corresponding dummy chamber.

3. The liquid ejection head according to claim 2, wherein the stack structure includes a grooved plate formed with the dummy return channels, and the first relief groove and the dummy return channels are open on one and same surface of two facing surfaces of the grooved plate.

4. The liquid ejection head according to claim 2, wherein the dummy return channels are arranged in the array direction, and wherein the first relief groove includes first groove portions each connected to an end of a corresponding one of the dummy return channels, and second groove portions each connected to corresponding at least two of the first groove portions, each of the second groove portions extending in the array direction in a curved manner to surround a nearest one of ends of the dummy return channels.

5. The liquid ejection head according to claim 2, comprising:

an array of the dummy return channels which are arranged in the array direction;

an array of the return throttle channels which are arranged in the array direction, the array of the return throttle channels being located laterally to the array of the dummy return channels, in a direction orthogonal to the array direction; and an edge portion located opposite to the array of the return throttle channels relative to the array of the dummy return channels in a direction orthogonal to the array direction.

6. The liquid ejection head according to claim 1, further comprising a communication passage communicating the first relief groove with an exterior of the stack structure.

7. The liquid ejection head according to claim 6, further comprising a lid configured to shut the communication passage from the exterior.

8. The liquid ejection head according to claim 6, further comprising a second relief groove configured to trap therein the excessive adhesive agent between the adjacent plates, wherein the second relief groove is not connected to the dummy channels, and the second relief groove and the communication passage are separate from each other.

9. The liquid ejection head according to claim 1, wherein each of the dummy channels includes:

a dummy return channel located, at a layer belonging to the stack structure and having the return throttle channels, to be connected to a corresponding one of the dummy chambers and have a smaller cross-sectional area than the corresponding dummy chamber, and a dummy supply channel located, at a layer belonging to the stack structure and having the supply throttle channels, to be connected to the corresponding dummy chamber and have a smaller cross-sectional area than the corresponding dummy chamber, and wherein the first relief groove includes a return-side relief groove connected to the dummy return channels, and a supply-side relief groove connected to the dummy supply channels.

10. The liquid ejection head according to claim 9, further comprising a communication passage common to the return-side relief groove and the supply-side relief groove and configured to communicate the return-side relief groove and the supply-side relief groove with an exterior of the stack structure.

11. The liquid ejection head according to claim 1, wherein the dummy chambers are filled with no liquid.

12. The liquid ejection head according to claim 1, wherein the first relief groove includes a chamber-side relief groove connected to the dummy chambers.

13. The liquid ejection head according to claim 1, wherein the stack structure includes a grooved plate formed with the first relief groove, and the first relief groove is recessed from one of two facing surfaces of the grooved plate and does not penetrate through the two facing surfaces.

14. The liquid ejection head according to claim 1, wherein the stack structure includes an ejection surface on which the nozzles are open but the dummy channels are not open.

* * * * *